United States Patent [19]

DeWeese

[11] 4,111,423

[45] Sep. 5, 1978

[54] TRAP SHOOT SIMULATOR AND METHOD

[76] Inventor: Herbert F. DeWeese, 7650 E. Juanita Ave., Mesa, Ariz. 85208

[21] Appl. No.: 797,529

[22] Filed: May 16, 1977

[51] Int. Cl.[2] ..... F41J 9/00; F41J 9/16

[52] U.S. Cl. ..... 273/101.1; 273/105.1

[58] Field of Search ..... 273/101.1, 101.2, 105; 362/287

[56] References Cited

U.S. PATENT DOCUMENTS

| | | | |
|---|---|---|---|
| 2,665,133 | 1/1954 | Garrido | 273/105.1 |
| 2,668,230 | 2/1954 | Hooker et al. | 273/101.2 |
| 3,220,732 | 11/1965 | Pincus | 273/101.1 |
| 4,052,066 | 10/1977 | Ohta | 273/101.1 |

*Primary Examiner*—Richard C. Pinkham
*Assistant Examiner*—Lawrence E. Anderson
*Attorney, Agent, or Firm*—James W. McFarland

[57] ABSTRACT

Method and apparatus for simulating trap shooting by utilizing a pair of separate electrical drive motors to move a light source about two separate axes. Control structure provide a logic sequence of operation causing the light source to project a beam of light having only upward vertical motion at a random azimuthal angle to simulate the flight of objects in trap shooting.

17 Claims, 7 Drawing Figures

TRAP SHOOT SIMULATOR AND METHOD

BACKGROUND OF THE INVENTION

This invention relates to method and apparatus for simulating trap shooting, and relates more particularly to a light projector which produces a beam of light on a remote screen that simulates the flight of an object used in trap shooting.

Various arrangements have previously been devised in an attempt to provide a light projector that simulates the flight of a bird. For instance, U.S. Pat. No. 3,904,204 discloses a simulated clay shooting system which includes a projector providing a visible mark, and a projector with an invisible mark for simulating lead-sighting. U.S. Pat. No. 3,215,035 discloses a target projector that produces a revolving target on a screen. U.S. Pat. No. 2,995,834 discloses a wing shot training device with a projector simulating the flight of a bird or clay target. U.S. Pat. No. 2,644,884 discloses various cam and follower mechanisms for projecting a target image on the screen in irregular motion. Other types of mechanisms for simulating a movable target for practice firing are disclosed in U.S. Pat. Nos. 2,309,614; 2,456,828; 2,527,236; 2,593,117; 2,665,133; 3,411,785; and 3,502,333. None of these prior arrangements however, contemplate a light projector which provides an upwardly moving target traveling along a random azimuthal angle to simulate the objects in trap shooting.

SUMMARY OF THE INVENTION

Accordingly, it is an important object of the present invention to provide an improved light projector method and apparatus for simulating the flight of objects in trap shooting or the like to permit shooting practice and training in an enclosed area by a person using his own gun with which he is familiar, and without expenditure of supplies used in actual trap shooting.

More particularly, it is an important object of the present invention to provide a light projector and method which produces a beam of light that moves only upwardly on the projector screen, and which moves at a randomly selected azimuthal angle. The projector further includes control circuitry providing a logic sequence which automatically, upon selected initiation of the projector stops the light source of the projector at a randomly selected azimuthal angle, energizes the light source, drives the light source such that the beam of light moves upwardly, then de-energizes the light source and restarts movement to a different azimuthal angle upon reaching the maximum vertical position, while allowing the light source to reset to its minimum vertical position.

More particularly, the present invention contemplates a first drive motor and drive connection which is operably connected to rotate a frame about a first axis. A light source is pivotally mounted to the frame about a pivot axis that rotates about the first axis. A second continuously rotatable electrical drive motor is carried by the movable frame to pivot the light source about the pivot axis connecting the light source to the frame. Cam operated micro switches sense the location of the light source and more particularly sense the maximum and minimum vertical positions thereof. Control circuitry normally provides continuous operation of the motor driving the frame while the motor mounted to the frame is inactive. Upon throwing a manual switch, the motor driving the frame is stopped to position the light source at a randomly located azimuthal angle, the light source is energized, and the second motor started to drive the light source in upward vertical movement. Upon reaching maximum vertical position the light source is de-energized, and the motor driving the frame is restarted. Once the light source returns to its minimum vertical position the second motor is stopped and an indicator light is energized to show that the light is reset to its minimum vertical location.

These and other objects and advantages of the present invention are specifically set forth in or will become apparent from the following detailed description of a preferred embodiment of the invention when read in conjunction with the accompanying drawings.

DETAILED DESCRIPTION OF THE PREFERRED EMBODIMENT

Figure 1:
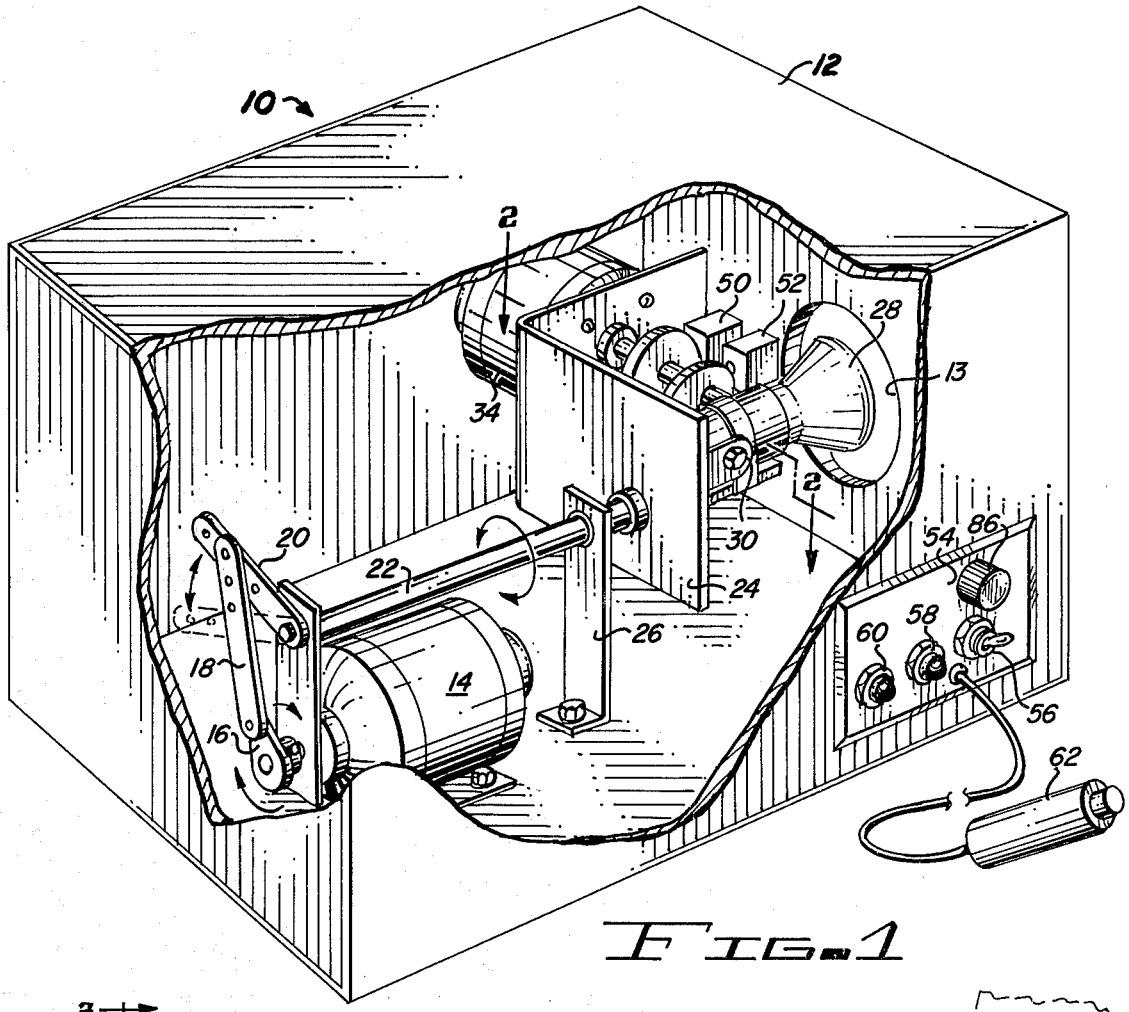
FIG. 1 is a perspective view of a light projector as contemplated by the present invention with portions broken away to reveal internal details of constructions.

Referring now more particularly to the drawings, a light projector generally designated by the numeral 10 comprises an enclosed box-like base 12 having a light opening 13 in the front face thereof. Mounted within the interior of base 12 is a continuously rotatable electrical drive motor 14 whose output shaft acts through a crank 16, two bar linkage 18, 20 and a shaft 22 to rotate a frame 24 in an approximately 90° to 95° arc about the axis of shaft 22. Appropriate mounting structure 26 movably mount frame 24 to base 12.

Figure 2:
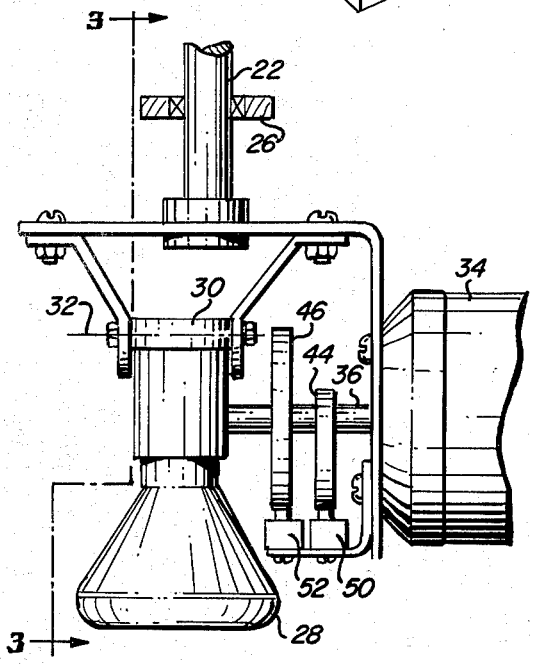
FIG. 2 is a top plan view of a portion of the rotary frame and light source as taken along lines 2—2 of FIG. 1.
Figure 3:
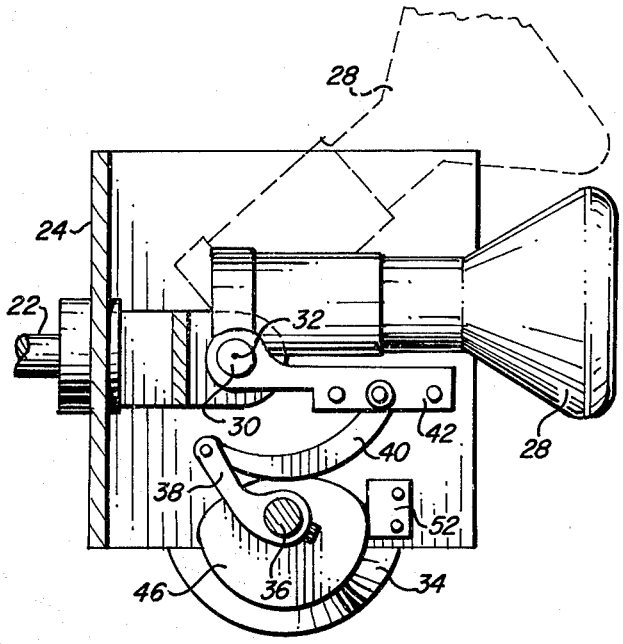
FIG. 3 is a side elevational view taken along lines 3—3 of FIG. 2.

An appropriate light source such as a high intensity lamp 28 is movably mounted to the right angle shaped frame 24 by a pivot 30 permitting vertically upward and downward rotation of light 28 about an axis 32. It is important to note that, as best illustrated in FIGS. 2 and 3, the light 28 is mounted on non-aligned relationship with respect to the longitudinal axis of shaft 22.

Another continuously rotatable electric drive motor 34 is carried upon movable frame 24 and has an output shaft 36 which acts through another drive connection comprising a crank 38 and links 40, 42 to pivot or rotate light 28 in an approximately 45° to 60° vertical arc up and down about the axis 32. The speed of motor 34 may be altered, if desired, by adjustment of a rheostat 86. A pair of cams 44, 46 on shaft 36 are respectively engageable with a pair of microswitches 50, 52. Cam 44 is arranged to depress switch 50 whenever the light 28 is at its minimum vertical position as illustrated in FIGS. 2 and 3. Similarly, cam 46 includes a full semi-circular section for depressing microswitch 52 throughout approximately one-half a revolution of shaft 36 during upward motion of light 28, and is configured to allow release of switch 52 during the other one-half revolution while light 28 is moving downwardly.

Figure 4:
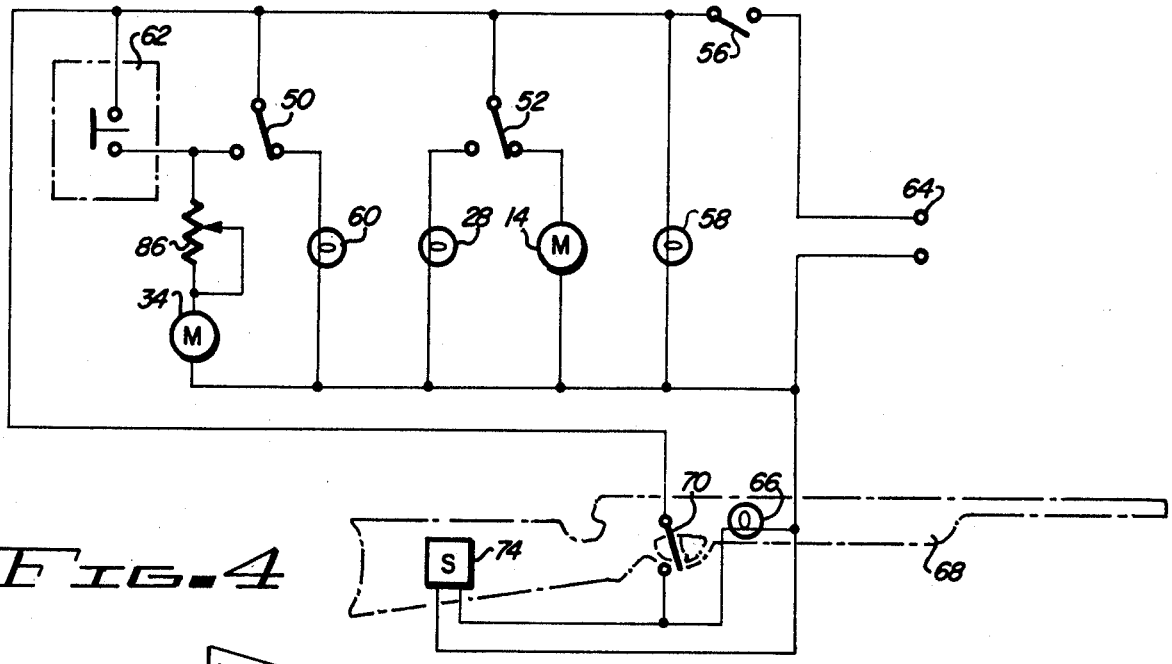
FIG. 4 is a schematic of the control circuitry.

The projector further includes an externally mounted control panel 54 having a main power switch 56, a "ready" indicator light 60, rheostat 86, and a remotely located pushbutton switch 62. In the electrical control circuitry as illustrated in FIG. 4, the indicator lights 58 and 60, target light 28, and electric motors 14, 34 all are arranged in parallel to an electrical power source 64. Microswitch 52 is in series relationship to motor 14 and target light 28, while microswitch 50 is in series relationship to the "ready" indicator light 60 and motor 34. Pushbutton switch 62 is connected to motor 34 in parallel relationship to microswitch 50.

Auxiliary equipment which may be utilized in conjunction with projector 10 include a second light source 66 releasably clamped to the barrel of a conventional gun 68, a microswitch 70 releasably attached to the gun to be operated by the trigger 72 thereof, and a plunger solenoid 74 releasably attached to the stock 76 of the gun. As clear from the circuitry of FIG. 4, closing of microswitch 70 by actuation of the trigger energizes the light source 66 to project a beam simulating gun firing, and solenoid 74 is activated to produce an impact at the gun stock simulating gun recoil.

Figure 7:
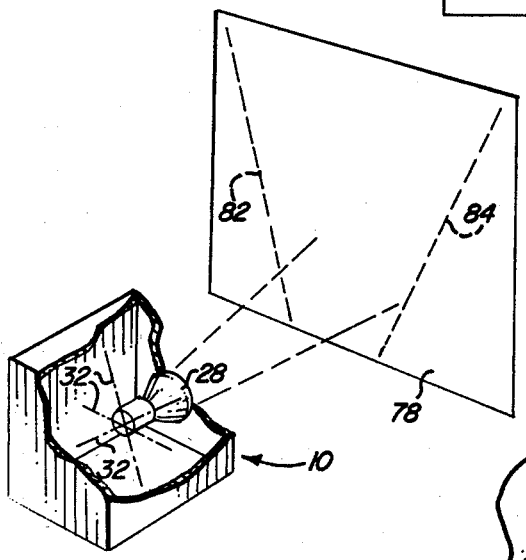
FIG. 7 is a perspective, partially schematic illustration of the projector of FIG. 1 and the projected light beam thereof.
Figure 5:
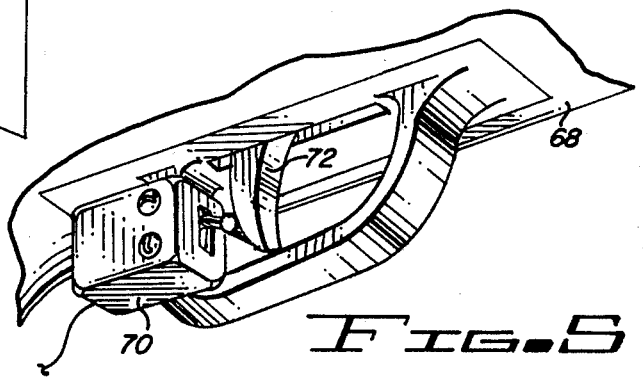
FIG. 5 is a detailed perspective view of a trigger switch mounted to a conventional gun.
Figure 6:
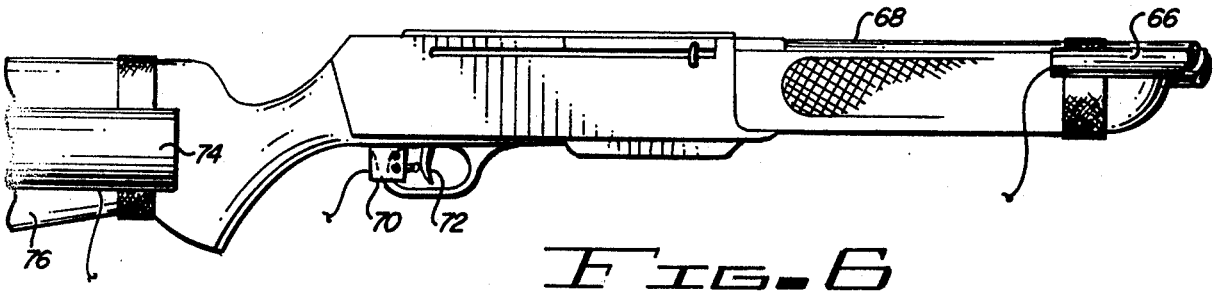
FIG. 6 is a partial side elevational view of a conventional gun with additional apparatus as contemplated by the present invention to be utilized in combination with the projector of FIG. 1.

In operation, light 28 is normally at its minimum vertical position as illustrated in FIGS. 2 and 3 with both cams 44, 46 respectively depressing the associated microswitches 50 and 52 to position the latter in their righthand position shown in FIG. 4. Upon closing main switch 56, the power indicator light 58 is energized. Swing motor 14 is started due to the position of switch 52, and indicator light 60 is energized by virtue of the position of microswitch 50. Thus one drive means comprising the motor 14 and the drive connection 16–22 associated therewith causes repetitive rotation of the frame and light 28 back and forth in an approximately 90° arc about the axis of shaft 22. As depicted in FIG. 7, the action of motor 14 causes the pivot axis 32 of the light to rock back and forth between preselected limits of different azimuthal angles in a plane extending generally perpendicular to the axis of shaft 22. The amount of change in the azimuthal angular position of the light 28 and the projected beam thereof upon the remote screen 78 is in relation to the degree of non-alignment between light 28 and the axis of shaft 22.

To simulate the release of a clay pigeon or other projectile utilized in trap shooting, push button switch 62 (which may be foot operated if desired) is momentarily depressed to energize drive motor 34. The drive means comprising motor 34 and associated drive connection 38–42 begins rotating light 28 upwardly from its minimum vertical position. The clockwise rotation of shaft 36 as illustrated in FIG. 3 disengages both cams 44, 46 from the associated microswitches 50, 52 to cause these microswitches to shift to their lefthand position shown in the FIG. 4 circuit. As a result, motor 14 is stopped to place the light 28 at a random azimuthal angle unknown to the person awaiting the simulated release of the clay pigeon. At the same time, the leftward switching of switch 52 energizes target light 28 to project a light beam onto the screen 78 simulating release of the target. The leftward movement of microswitch 50 assures continued operation of motor 34 after push button switch 62 is released. Once light 28 leaves its minimum vertical position and cam 44 releases switch 50, the "ready" indicator light 60 is de-energized.

Motor 34 continues rotating to drive light 28 toward its maximum vertical position illustrated in dashed lines in FIG. 3, thus causing upward flight movement of the projected beam of light on the screen 78 at the random azimuthal angle determined solely by the angle of rotation of motor 14 at the time it was de-energized. Once the maximum vertical light position is reached, the semi-circular portion of cam 46 again contacts and depresses switch 52 to shift the latter its righthand position of FIG. 4 to simultaneously de-energize light 28 and restart motor 14. Motor 34 continues operating until a complete full revolution of shaft 36 has occurred, whereupon cam 44 again depresses microswitch 50 to stop motor 34 and at the same time energize "ready" light 60 to indicate that light 28 has returned to its minimum vertical position in preparation for the next sequence of operation. It will be apparent that while light 28 is energized in projecting an upwardly moving beam of light at a random azimuthal angle on screen 78 between the preselected azimuthal angle limits 82, 84 shown in dashed lines in FIG. 7, that the gun operator will attempt to "hit" the moving light target by depressing trigger switch 70 to project a beam of light 60 from source 66 onto the screen 78. Thus it will be apparent that the present invention provides an improved projector and accompanying control logic circuitry which automatically resets the light 28 to its minimum vertical position after completion of the firing sequence. Motor 14 continues to pivot the light through a variety of azimuthal angles so that upon the next operation of the projector, the light 28 will be at a randomly selected azimuthal angle. If desired the light source may comprise a pair or other number of lights to simulate shooting "doubles."

I have found by providing an output speed on shafts 22 and 36 of about 0.75 rpm, and swinging shaft 22 through approximately a 90° arc while rotating pivot 30 through an approximately 45° to 60° arc, that the projected beam of light on the remote screen 78 approximately 5 to 8 feet distant simulates the speed and random direction of the flight of a clay pigeon released during trap shooting.

From the foregoing it will be apparent that the present invention provides first circuit means including switches 62, 50 and 52 which substantially simultaneously stop motor 14, energize light 28, and start motor 34 upon depressing switch 62. Further, second circuit means including switch 52 and the parallel interconnection of motor 14 and light 28, automatically de-energizes light 28 and restarts motor 14 when the light 28 reaches its maximum vertical position. Similarly, third circuit means including switch 50 and the parallel interconnection of motor 34 and light 60 stops the vertical rotation of light 28 to reset the latter at its minimum vertical position, and energizes indicator light 60 when light 28 reaches its minimum vertical position.

From the foregoing it will also be apparent that the present invention contemplates an improved method of simulating the flight of objects utilized in trap shooting which includes the steps of continually pivoting a light source back and forth between different azimuthal angles, then selectively stopping and pivoting motion at a random azimuth while simultaneously energizing the light and starting vertical upward movement thereof. Upon reaching maximum vertical position, the light source is de-energized and the pivoting motion restarted. Vertical downward movement continues to reset the light at its minimum position.

While a preferred embodiment of the invention has been specifically set forth above, the foregoing detailed description should be considered exemplary in nature and not as limiting to the scope and spirit of the invention as set forth in the appended claims.

Having described the invention with sufficient clarity that those skilled in the art may make and use it, I claim:

1. A method of simulating the flight of objects in trap shooting, comprising the steps of:

pivoting a de-energized light source back and forth through a range of azimuthal angles;

randomly stopping said pivoting motion to set the light source at a random one of the azimuthal angles, and substantially simultaneously therewith energizing the light source and starting generally upward vertical movement of the light source from a preselected minimum vertical position along the random azimuthal angle;

de-energizing the light source as the latter reaches a preselected maximum vertical position;

restarting said pivoting back and forth motion;

driving the light source vertically downwardly to said preselected minimum vertical position; and stopping vertical motion upon reaching said minimum vertical position.

2. A method as set forth in claim 1, wherein vertical motion is accomplished by rotating the light source about a first axis up and down through a preselected vertical arc in a motion starting and ending at said minimum vertical position relative to said first axis.

3. A method as set forth in claim 2, wherein said pivoting motion is accomplished by rotating the light source such that said first axis rotates back and forth through a preselected arc about a second axis extending generally perpendicularly to a plane containing said first axis.

4. A method as set forth in claim 3, wherein restarting of said pivoting back and forth motion occurs substantially simultaneously with de-energization of said light source.

5. A method as set forth in claim 4, further including the step of energizing an indicator light whenever rotation of the light source in said vertical arc ceases.

6. A projector for simulating trap shooting, comprising:

a light source for projecting a beam of light simulating the flight of objects in trap shooting;

first drive means for moving said light source generally vertically up and down between preselected maximum and minimum vertical positions;

second drive means for moving said light source back and forth through a range of azimuthal angles; and control means for controlling actuation of said first and second drive means and energization of the light source to randomly stop back and forth movement of said second drive means and to substantially simultaneously therewith start said first drive means for initiate upward vertical movement of said light source from said minimum vertical position along a random one of the azimuthal angles and energize said light source whereby said light source projects an upwardly moving beam of light along said random azimuthal angle, said control means also being for selectively stopping vertical movement when said light source returns to said minimum vertical position.

7. A projector as set forth in claim 6, further including a base, a frame movably mounted to said base, said light source being movably mounted to said frame, said first drive means being carried by said frame, and said second drive means being carried by said base.

8. A projector as set forth in claim 7, wherein said first drive means includes a first rotatable electric motor, and first linkage extending between said first motor and said light source for pivoting said light source about a first axis upwardly and downwardly through a preselected generally vertical arc.

9. A projector as set forth in claim 8, wherein said second drive means includes a second rotatable electric motor, and second linkage extending between said second motor and said frame for pivoting said frame about a second axis extending perpendicularly to the plane containing said first axis in a manner causing said first axis to rotate back and forth about said second axis between preselected limits.

10. A projector as set forth in claim 6, wherein said control means includes first circuit means for substantially simultaneously stopping said second drive means, energizing said light source, and starting said first drive means.

11. A projector as set forth in claim 10, wherein said control means further includes sensor means for sensing the vertical position of said light source, and second circuit means responsive to said sensor means and operable upon said light source reaching said maximum vertical position to substantially simultaneously de-energize said light source and restart said second drive means.

12. A projector as set forth in claim 11, wherein said control means further includes third circuit means responsive to said sensor means and operable upon said light source reaching said miminum vertical position to stop said first drive means.

13. A projector as set forth in claim 12, further including an indicator lamp, said third means operably coupled with said indicator lamp to energize the latter whenever said light source is at said minimum vertical position.

14. In combination with a projector as set forth in claim 6, a gun having a second light source thereon for simulating firing of the gun, and a switch operated by the trigger of said gun for actuating said second light source.

15. In combination as set forth in claim 14, a solenoid mounted to the stock of said gun and operated by said switch for simulating recoil upon energizing said second light source.

16. A method of simulating the flight of objects in trap shooting, comprising the steps of:

providing a light source mounted about a first axis for movement through a generally vertical arc;

pivoting the light source such that said first axis rotates back and forth through a preselected arc about a second axis generally perpendicular to a plane containing said first axis whereby the light source is moved through a range of azimuthal angles;

selectively stopping said pivoting motion to set the light source at one of the azimuthal angles and substantially simultaneously therewith energizing the light source and rotating the light source generally upwardly from a minimum vertical position about said first axis and along the one azimuthal angle;

de-energizing the light source when said light source reaches a maximum vertical position, and substantially simultaneously therewith restarting pivoting motion;

driving the light source vertically downwardly to said minimum vertical position; and substantially simultaneously stopping vertical motion of the light source and energizing an indicator light upon reaching said minimum vertical position.

17. A projector for simulating trap shooting, comprising:

a light source for projecting a beam of light simulating the flight of objects in trap shooting;

first drive means for moving said light source generally vertically up and down between preselected maximum and minimum vertical positions;

second drive means for moving said light source back and forth through a range of azimuthal angles;

control means for controlling actuation of said first and second drive means and energization of said light source, said control means including first circuit means for substantially simultaneously stopping said second drive means, energizing said light source, and starting said first drive means to drive said light source upwardly from said minimum vertical position, sensor means for sensing the vertical position of said light source, second circuit means responsive to said sensor means and operable upon said light source reaching said maximum vertical position to substantially simultaneously de-energize said light source and restart said second drive means, and third circuit means responsive to said sensor means and operable upon said light source returning to said minimum vertical position to stop said first drive means; and an indicator lamp connected with said third circuit means for energization of said lamp when said light source is in said minimum vertical position.

* * * * *